US010297899B2

(12) United States Patent
Ziv

(10) Patent No.: US 10,297,899 B2
(45) Date of Patent: May 21, 2019

(54) COMPACT ANTENNA STRUCTURE

(71) Applicant: Galtronics Corporations Ltd., Tiberias (IL)

(72) Inventor: Yaniv Ziv, Upper Tiberias (IL)

(73) Assignee: GALTRONICS USA, INC., Tempe, AZ (US)

( * ) Notice: Subject to any disclaimer, the term of this patent is extended or adjusted under 35 U.S.C. 154(b) by 555 days.

(21) Appl. No.: 14/989,982

(22) Filed: Jan. 7, 2016

(65) Prior Publication Data

US 2016/0197395 A1 Jul. 7, 2016

Related U.S. Application Data

(60) Provisional application No. 62/100,647, filed on Jan. 7, 2015.

(51) Int. Cl.

| | |
|---|---|
| ***H01Q 1/24*** | (2006.01) |
| ***H01Q 5/50*** | (2015.01) |
| ***H01Q 5/10*** | (2015.01) |
| ***H01Q 1/52*** | (2006.01) |
| ***H01Q 1/38*** | (2006.01) |

(Continued)

(52) U.S. Cl.

CPC ..... *H01Q 1/24* (2013.01); *H01Q 1/38* (2013.01); *H01Q 1/48* (2013.01); *H01Q 1/521* (2013.01); *H01Q 5/10* (2015.01); *H01Q 5/392* (2015.01); *H01Q 5/40* (2015.01); *H01Q 5/50* (2015.01); *H01Q 9/30* (2013.01); *H01Q 9/40* (2013.01); *H01Q 9/42* (2013.01)

(58) Field of Classification Search

CPC .. H01Q 1/24; H01Q 5/40; H01Q 5/50; H01Q 1/38; H01Q 1/48; H01Q 9/30; H01Q 9/40; H01Q 9/42

USPC ..... 343/700 MS, 702, 725, 841, 846

See application file for complete search history.

(56) References Cited

U.S. PATENT DOCUMENTS

| | | | | |
|---|---|---|---|---|
| 7,079,079 B2 * | 7/2006 | Jo | ..... | H01Q 1/243 343/700 MS |
| 2010/0149751 A1 * | 6/2010 | Camacho | ..... | G06F 1/1616 361/679.55 |

(Continued)

OTHER PUBLICATIONS

EPO, International Search Report and Written Opinion issued in International Application No. PCT/IB2016/050051, dated Jun. 30, 2016.

*Primary Examiner* — Dameon E Levi
*Assistant Examiner* — Hasan Z Islam
(74) *Attorney, Agent, or Firm* — Lorenz & Kopf, LLP

(57) ABSTRACT

An antenna device is provided. The antenna device may include, but is not limited to, a first feed cable including a conductive core and a conductive shielding, a substrate, a monopole antenna mounted to the substrate, the monopole antenna galvanically coupled to the conductive core of the first feed cable and configured to radiate within a first frequency band when fed a signal from the conductive core of the feed cable, and a conductive coupling element galvanically coupled to the conductive shielding of the feed cable. The conductive coupling element may include a first conductive element configured to radiate within a second frequency band when the monopole is fed a signal from the conductive core of the feed cable, and a second conductive element configured to radiate within a third frequency band when the monopole is fed a signal from the conductive core of the feed cable.

18 Claims, 2 Drawing Sheets

(51) Int. Cl.

| | |
|---|---|
| ***H01Q 1/48*** | (2006.01) |
| ***H01Q 9/30*** | (2006.01) |
| ***H01Q 9/40*** | (2006.01) |
| ***H01Q 9/42*** | (2006.01) |
| ***H01Q 5/392*** | (2015.01) |
| ***H01Q 5/40*** | (2015.01) |

(56) References Cited

U.S. PATENT DOCUMENTS

| | | | | |
|---|---|---|---|---|
| 2012/0223866 | A1 | 9/2012 | Vazquez et al. | |
| 2013/0063310 | A1* | 3/2013 | Mak | H01Q 1/246 343/700 MS |
| 2013/0162494 | A1 | 6/2013 | Wong et al. | |
| 2014/0132469 | A1* | 5/2014 | Wang | H01Q 1/2266 343/821 |
| 2014/0256388 | A1* | 9/2014 | Lin | H04M 1/0202 455/575.7 |

* cited by examiner

COMPACT ANTENNA STRUCTURE

CROSS-REFERENCE TO RELATED APPLICATION(S)

This application claims the benefit of U.S. provisional patent application Ser. No. 62/100,647 filed Jan. 7, 2015, the entire content of which is incorporated by reference herein.

TECHNICAL FIELD

The present disclosure generally relates to antennas, and more particularly relates to compact wideband multiband antennas.

BACKGROUND

Modern devices, such as vehicles, cellular phones, commercial or industrial equipment, and the like often utilize multiple antennas for receiving and/or broadcasting radio signals over multiple frequency ranges. However, when multiple antennas are mounted in close proximity, the antennas can interfere with one another, degrading the performance of both antennas. Another important issue is the overall size of the antenna.

BRIEF SUMMARY

In one embodiment, for example, an antenna device is provided. The antenna device may include, but is not limited to, a first feed cable including, but not limited to, a conductive core and a conductive shielding, a substrate, wherein the substrate does not include a sufficient counterpoise for low cellular bands, a monopole antenna mounted to the substrate, the monopole antenna galvanically coupled to the conductive core of the first feed cable, the monopole antenna configured to radiate within a first frequency band when fed a signal from the conductive core of the first feed cable, and a conductive coupling element galvanically coupled to the conductive shielding of the first feed cable, the conductive coupling element including, but not limited to, a first conductive element configured to radiate within a second frequency band when the monopole antenna is fed the signal from the conductive core of the first feed cable, and a second conductive element configured to radiate within a third frequency band when the monopole antenna is fed the signal from the conductive core of the first feed cable.

In another embodiment, for example, a location device is provided. The location device may include, but is not limited to, a controller controlling a radio unit, a first feed cable including, but not limited to, a conductive core coupled to the radio unit controlled by the controller and a conductive shielding, a second feed cable comprising a conductive core coupled to the radio unit controlled by the controller and a conductive shielding, a substrate, wherein the substrate does not include a sufficient counterpoise for low cellular bands, a global positioning system antenna mounted to the substrate, the global positioning system antenna galvanically connected to the second feed cable, a monopole antenna mounted to the substrate, the monopole antenna galvanically coupled to the conductive core of the first feed cable, the monopole antenna configured to radiate within a first frequency band when fed a signal by the controller through the conductive core of the first feed cable, and a conductive coupling element galvanically coupled to the conductive shielding of the first feed cable, the conductive coupling element including, but not limited to, a first conductive element configured to radiate within a second frequency band when the monopole antenna is fed the signal by the controller through the conductive core of the first feed cable, and a second conductive element configured to radiate within a third frequency band when the monopole antenna is fed the signal by the controller through the conductive core of the first feed cable.

In yet another embodiment, for example, an antenna device, is provided. The antenna device may include, but is not limited to, a first feed cable including, but not limited to, a conductive core and a conductive shielding, a substrate, wherein the substrate does not include a sufficient counterpoise for low cellular bands, a monopole antenna mounted to the substrate, the monopole antenna galvanically coupled to the conductive core of the first feed cable, the monopole antenna configured to radiate within a first frequency band when fed a signal from the conductive core of the first feed cable, and a conductive coupling element galvanically coupled to the conductive shielding of the first feed cable, the conductive coupling element including, but not limited to a first conductive element configured to radiate within a second frequency band when the monopole antenna is fed the signal from the conductive core of the first feed cable, the first conductive element including, but not limited to at least one conductive linear segment galvanically coupled to the conductive shielding of the first feed cable, a conductive tip galvanically coupled to the at least one conductive linear segment, and a second conductive element configured to radiate within a third frequency band when the monopole antenna is fed the signal from the conductive core of the first feed cable, the second conductive element including, but not limited to a conductive linear segment galvanically coupled to the conductive tip of the first conductive element, and a conductive end galvanically coupled to the conductive linear segment of the second conductive element.

BRIEF DESCRIPTION OF THE DRAWINGS

The detailed description will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or detail of the following detailed description.

Figure 1:
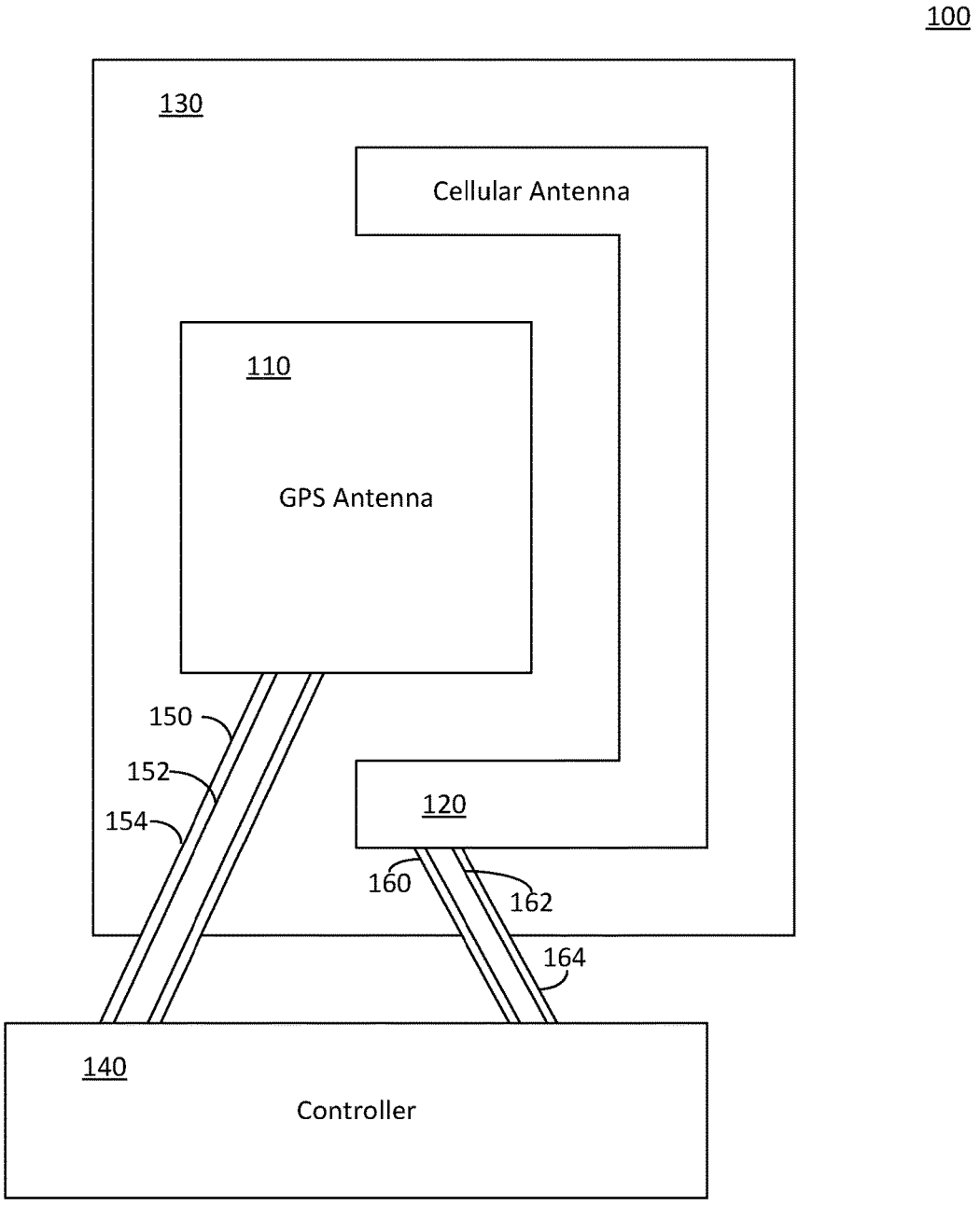
FIG. 1 is a block diagram of an antenna device, in accordance with an embodiment.

FIG. 1 is a block diagram of an antenna device 100, in accordance with an embodiment. The antenna device 100 may be used, for example, as a location device for determining the location of a vehicle (automobile, helicopter, aircraft, spacecraft, watercraft, or the like), a person or any other moveable object to which the antenna device 100 is attached or otherwise carried.

The antenna device 100 includes a global positioning system (GPS) antenna 110 and a cellular antenna 120. The GPS antenna 110 is configured to receive signals from multiple satellites. A processor, such as controller 140, can process the signals received from the satellites to determine a location of the antenna device 100. The cellular antenna 120 is configured to communicate with one or more cellular antenna devices, such as cellular towers. A processor, such as the controller 140, can process the signals received from the cellular antenna 120 to determine a location of the antenna device 100 using techniques such as cell identification, triangulation, and forward link timing methods. The controller 140 can also utilize the cellular antenna 120 to report the GPS determined location or the cellular determine location of the antenna device 100. One advantage of the antenna device 100 is that by using both a GPS antenna 110 and a cellular antenna 120 the antenna device 100 can provide a more consistent location as the cellular antenna 120 may be able to provide location data when the GPS antenna 110 cannot and the GPS antenna 110 may be able to provide location data when the cellular antenna 120 cannot.

However, as discussed above, when multiple antennas such as a GPS antenna 110 and a cellular antenna 120 are packaged together within close proximity, the GPS antenna 110 can cause interference which may adversely affect the cellular antenna 120 and the cellular antenna 120 can cause interference which may adversely affect the GPS antenna 110. In the embodiments illustrated in FIG. 1 and in FIG. 2, which discussed in further detail below, the GPS antenna 110 and the cellular antenna may be separated by around 1.15 mm. Accordingly, as discussed in further detail below, the cellular antenna 120 is arranged to compensate for the presence of the GPS antenna 110.

The GPS antenna 110 and the cellular antenna 120 are arranged on a substrate 130. The substrate 130 may be, for example, a printed circuit board (PCB), or any other non-conductive material. The GPS antenna 110 and the cellular antenna 120 may be mounted on the substrate 130 in a variety of ways. In one embodiment, for example, the cellular antenna 120 may be chemically or electrically deposited on the substrate 130, printed on the substrate 130, formed from sheet metal and glued, soldered, or the like, onto the substrate 130, or the like. In one embodiment, for example, the GPS antenna 110 may be performed and glued, soldered, or the like onto the substrate 130.

One advantage of the arrangement of the cellular antenna 120 discussed below is that the cellular antenna 120 does not need a large counterpoise (otherwise known as a ground plane) to operate. Accordingly, in the embodiment illustrated in FIG. 1 the substrate 130 does not include a counterpoise for all cellular frequencies. However, in another embodiment, for example, the antenna device 100 may include a small counterpoise as part of the GPS antenna 110 or on the substrate 130 beneath the GPS antenna 110. The small counterpoise for the GPS antenna 110 allows the GPS antenna 110 to operate effectively but does not provide a resonance condition for the cellular antenna 120.

While the substrate 130 illustrated in FIG. 1 is rectangular, the substrate 130 may have a variety of shapes. As discussed in further detail below, the shape of the substrate 130 may affect the shape of one or more of the components of the cellular antenna 120.

As discussed above, the antenna device 100 may further include a controller 140. In one embodiment, for example, the controller 140 may include a processor such as a central processing unit (CPU), a microcontroller, an application specific integrated circuit (ASIC), a field programmable gate array, or any other logic device or combination thereof. The controller 140 may receive one or more signals signal from the GPS antenna 110 and cellular antenna 120 to, for example, determine a location of the antenna device 100 and can send a signal to the cellular antenna 120 to report the location. As discussed in further detail below, the controller 140 may cause a signal to be generated causing one or more elements of the cellular antenna to radiate within a frequency band. In one embodiment, for example, the controller 140 may utilize a radio frequency (RF) signal source and a modulator to generate the signal which may be part of the controller 140, or separate units from the controller 140.

The signals between the radio frequency (RF) signal source and the modulator controlled by controller 140 and the GPS antenna 110 and the cellular antenna 120 may be transmitted over feed cables 150 and 160. Each feed cable 150 and 160 may include a conductive core 152 and 162, respectively, and a conductive shielding 154 and 164, respectively. In one embodiment for example, the feed cables 150 and 160 may be coaxial style cables. However, any cable providing an appropriate impedance and including a conductive core and a conductive shielding could be used.

Figure 2:
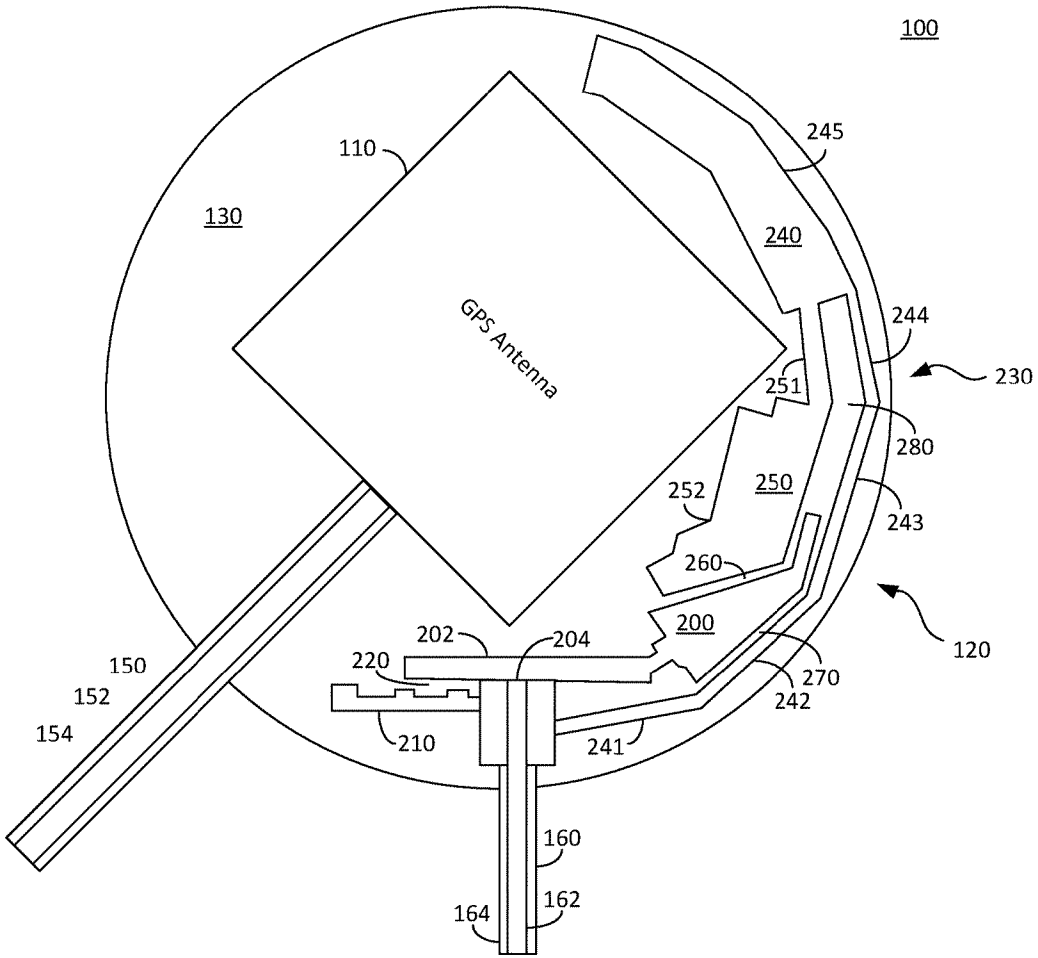
FIG. 2 is a view of an exemplary the antenna device, in accordance with an embodiment.

FIG. 2 is a view of an exemplary the antenna device 100, in accordance with an embodiment. The substrate 130 illustrated in FIG. 2 is substantially circular in shape. However, as discussed above, the substrate 130 may be formed to have a variety of shapes.

As seen in FIG. 2, the cellular antenna 120 includes a monopole 200. The monopole 200 is coupled to the core 162 of the feed cable 160. The monopole 200 may be chemically or electrically deposited on the substrate 130, printed on the substrate 130, or otherwise formed utilizing any of the methods discussed above. When the monopole 200 receives a high band signal, such as a high band cellular frequency signal, from the feed cable 160, the monopole 200 radiates within a frequency band defined by a length of the monopole 200. In other words, the frequency band at which the monopole 200 radiates can be selected by modifying a length of the monopole 200. When the monopole 200 receives a low band signal, such as a low band cellular frequency signal, from the feed cable 160, the monopole 200 couples to a conductive coupling element 230, as discussed in further detail below.

The shape of the monopole 200 illustrated in FIG. 2 includes a linear segment angularly coupled to an end of a substantially triangular segment which in turn is angularly coupled to another linear segment. This exemplary shape allows for a suitable connection to the conductive coupling element 230, as discussed in further detail below. However, the monopole 200 could be constructed to have a wide variety of shapes which allow for a suitable connection to the conductive coupling element 230.

In one embodiment, for example, the monopole 200 may include a conductive extension 202. The conductive extensions 202 capacitively couples with a tuning element 210. The conductive extension 202 illustrated in FIG. 2 extends in a substantially opposite direction from the monopole 200 at a feed point 204 which connects the conductive core 162 of the feed cable 160 to the monopole 200. However, the conductive extensions 202 may extend in any direction from the feed point so long as the position of the tuning element 210 is also changed to maintain the capacitive coupling therebetween. As seen in FIG. 2, the monopole 200 and the conductive extension 202 of the monopole 200 are formed as a single conductive element. As discussed above, the monopole and the conductive extension 202 of the monopole may be chemically or electrically deposited on the substrate 130, printed on the substrate 130, or otherwise formed utilizing any of the methods discussed above.

The tuning element 210 is coupled to the shielding portion 164 of the feed cable 160. The capacitive coupling between the tuning element 210 and the conductive extension 202 allows the tuning element 210 to alter a resonance frequency of the monopole 200. In other words, the capacitive coupling alters the total impedance of the antenna providing improved matching which allows for higher radio frequency currents. In the embodiment illustrated in FIG. 2, the tuning element 210 includes a labyrinth shaped upper edge. In one embodiment, for example, a capacitor may be soldered at the location of the bulges to further alter the resonance frequency and to improve matching between the input of the antenna and the output of the antenna. A well matched antenna has equal input resistance and output resistance and an equal, but oppositely directed, input reactance and output reactance. Accordingly, by altering the resonance frequency of the monopole 200 via the tuning element and the conductive extension, the matching of the antenna can be improved by altering one or more of the input resistance and input reactance.

The cellular antenna 120 further includes a conductive coupling element 230. The conductive coupling element 230 may be chemically or electrically deposited on the substrate 130, printed on the substrate 130 (e.g., via a 3D printing system), or otherwise formed utilizing any of the methods discussed above. The conductive coupling element 230, like the tuning element 210, is coupled to the shielding portion 164 of the feed cable 160.

The conductive coupling element 230 includes a conductive element 240 which has a first end galvanically connected to the shielding portion 164 of the feed cable 160. The conductive element 240 illustrated in FIG. 2 includes galvancially coupled conductive linear segments 241-244 and a conductive tip 245. The conductive coupling element 230 further includes conductive element 250. The conductive element 250 includes a conductive linear segment 251 and a conductive end 252. While the conductive coupling element 230 is described as having components 240-245 and 250-252, the conductive coupling element 230 may be formed from a single conductive strip which is deposited, printed or otherwise attached to the substrate 130 according to any of the methods discussed above.

The conductive element 240 has an overall length which affects an operating frequency of the cellular antenna 120. The overall length of the conductive element 240 includes the electrical length of each of the conductive linear segments 241-244 as well as the electrical length of the conductive tip 245. In one embodiment, for example, the overall length of the conductive element 240 may be ninety millimeters (mm). However, the length of the conductive element 240 may be adjusted depending upon a desired operating range of the cellular antenna 120, as discussed in further detail below. The frequency band which the conductive element 240 is based upon the length of the conductive element 240 and which is adjusted for the presence of the GPS antenna, as discussed below. The conductive element 240 may radiate around, for example, 850 MHz, however the frequency can be adjusted by adjusting the length of the components of the conductive element 240.

While the conductive element 240 is illustrated in this embodiment as having four conductive linear segments 241-244 each coupled to each other at an angle and a conductive tip 245 which itself is has segments to account for the circular shape of the substrate 130, the components 241-245 of the conductive element 240 could have a variety of shapes depending upon the shape of the substrate 130 and the overall desired dimensions of the antenna device 100. For example, the conductive element 240 could be curved rather than having the linear segments 241-244. In the embodiment illustrated in FIG. 1, for example, where the substrate 130 is rectangular, the linear segments may be connected at ninety-degree angles.

As discussed above, the conductive element 250 includes a conductive linear segment 251 and a conductive end 252. The conductive linear segment 251 is linearly shaped and is coupled to the conductive tip 245 along a bottom of the conductive tip 245 next to where the conductive linear segment 244 couples to the conductive tip. As discussed in further detail below, the conductive element 250 is arranged to radiate within a frequency band when the monopole 200 receives a signal from the feed cable 160. The frequency band which the conductive element 250 is based upon the length of the conductive element 250 and which is adjusted for the presence of the GPS antenna, as discussed below. The conductive element 250 may radiate around, for example, 900 MHz, however the frequency can be adjusted by adjusting the length of the components of the conductive element 250.

Accordingly, as the cellular antenna 120 includes a monopole 200 operating in a frequency band, a conductive element 240 operating in yet another frequency band, and another conductive element 250 operating in yet another frequency band, the cellular antenna 120 is capable of operating as a compact wideband multiband antenna capable of radiating at, for example, frequencies between 800-960 megahertz (MHz) and 1.7-2.2 gigahertz (GHz). However, as discussed above, the frequency band at which the cellular antenna 120 is capable of operating can be altered by adjusting the length of one or more of the components of the cellular antenna 120.

As seen in FIG. 2, the conductive coupling element 230 is arranged to be adjacent to the monopole 200. More specifically, in the embodiment illustrated in FIG. 2, the conductive end 252 and the monopole 200 are arranged proximate to each other to form a gap 260. In one embodiment, for example, the gap 260 may be fifteen millimeters in length. Likewise, the monopole 200 and the conductive linear segments 242 and 243 of the conductive element 240 are arranged proximate to each other to form a gap 270. In one embodiment, for example, the gap 270 may be fourteen millimeters in length. The arrangement of the monopole 200 and the components of the conductive coupling element 230 also form a slot 280. In one embodiment, for example, the slot 280 may also radiate when the monopole 200 receives a signal from the feed cable 160 and may operate within the low edge of the high band of the cellular antenna 120. In the embodiment illustrated in FIG. 2, the length of the slot is about thirty millimeters. However, the length of the slot 280 may be altered depending upon a desired operating frequency of the slot 280.

In operation, when the monopole 200 is fed a signal from the conductive core 162 of the feed cable 160 at the feed point 204, the monopole 200 radiates within a frequency band, as discussed above. Because the monopole 200 and the conductive coupling element 230 are arranged with the gaps 260 and 270, as discussed above, the monopole 200 inductively and capacitively couples to the conductive coupling element 230 across the gaps 260 and 270 when the monopole 200 receives a signal from the feed cable 160. The inductive and capacitive coupling causes the conductive element 240 to radiate within a frequency band based upon the length of the conductive element 240, as discussed above, and the conductive element 250 to radiate within a different frequency band based upon the length of the conductive coupling element 250, as discussed above. The slot 280 may also radiate when the monopole 200 receives a signal from the feed cable 160 based upon the length of the slot, as discussed above.

As discussed above, the close proximity of the GPS antenna 110 can negatively affect the performance of the cellular antenna 120. In the embodiment illustrated in FIG. 2, for example, the distance between the GPS antenna 110 and the cellular antenna 120 may be as little as 1.15 mm. The proximity of the GPS antenna 110 causes loading on the conductive element 240 and the conductive element 250, increasing their electrical length. Accordingly, the lengths of the conductive element 240 and the conductive element 250 are compensated to correct for the effect of the GPS antenna 110 by reducing their lengths by about five millimeters.

One advantage of the cellular antenna 120 illustrated in FIG. 2 is that the monopole 200 and the conductive coupling element 230 are capable of radiating over a wide band covering the frequency ranges of multiple cellular standards, such as GSM 850/1900 and GSM 900/1800. This allows the same antenna device 100 to operate in multiple countries and continents, improving the reliability of the antenna device 100. For example, when the antenna device 100 is implemented as a tracking device, the cellular antenna 120 illustrated in FIG. 2 would allow the antenna device 100 to report a location even if the antenna device 100 were transported across borders or oceans.

Another advantage of the arrangement of the cellular antenna 120 discussed herein is that the substrate 130 does not require a full size ground plane for the cellular antenna 120. An effective antenna is in resonance, or in other words, an antenna is effective when it has a low reactance. In general, most existing quarter wave antenna elements are most effectively in resonance when mounted over a ground plane. However, the cellular antennas 120 illustrated in FIGS. 1 and 2 are different. In these embodiments, there is no large ground plane perpendicular to the monopole 200 and conductive coupling element 230. While the antenna device 100 includes a small ground plane for the GPS antenna 110, as discussed above, the ground plane (i.e., a conductive layer) for the GPS antenna 110 is not a sufficient counterpoise for low cellular bands as it is not even galvanically connected to the cellular antenna 120 or to the shielding of the feed cable 160. Further, while there can be some loose coupling between the long shielding of the feeding cables 150 and 160, the ground plane for the GPS antenna 100 cannot effectively provide a ground for the cellular antenna 120 because the size of the ground plane of the GPS antenna 110 is very small compared to the wavelength of the cellular antenna in low bands, therefore the ground plane of the GPS antenna 110 is far from resonance condition, and the impedance of the ground plane of the GPS antenna 110 has a large reactive component. Accordingly, the current of the cellular antenna 120 would be limited and only weak radiation of the cellular antenna 120 in low cellular bands would be possible.

As discussed above, the conductive shielding 164 of the feed cable 160 is arranged to be an effective counterpoise. The structure of the cellular antenna 120 is advantageous as in order to be in resonance the length of a typical cellular antenna needs to be ½ wave long. However, the cellular antenna 120 illustrated in FIGS. 1 and 2 only needs to be ¼ wave length. In other words, by utilizing the feed cable 160 as the counterpoise rather than a large ground place, the size of the substrate 130 and the whole antenna device 100 can be reduced by almost fifty percent compared to conventional devices. In the embodiment illustrated in FIG. 2, for example, the substrate is around five centimeters in diameter.

Another advantage of the cellular antenna structure 120 illustrated in FIG. 2 is that the conductive shielding 162 of the feed cable 160 can be made to radiate in the lower cellular frequency band by the monopole's 200 coupling to the conductive element 230.

The conductive shielding 154 of the feed cable 150 of the GPS antenna 110 is connected directly to GPS ground plane, which is either integrated into a GPS chip or located on the substrate 130 below the GPS antenna 110, as discussed above. As discussed above, the conductive shielding 164 of the feed cable 160 operates as the counterpoise for the cellular antenna 120 when the cellular antenna is operating in the lower frequency band for cellular communications. The GPS ground plane is large enough to act as a ground plane for the GPS antenna 110 which operates around 1.575 GHz. The ground plane of the GPS antenna can also operate as a counterpoise for the cellular antenna 120 when the cellular antenna is operating in the higher end of the cellular frequency bands, typically between 1.71 GHz and 2.7 GHz. The cellular antenna 120, however, is not directly coupled to the ground plane of the GPS antenna 110. The conductive shieldings 154 and 164 of the feed cables 150 and 160 can be coupled to the same ground where the antenna device 100 is installed, and, thus there would be coupling between the conductive shieldings 154 and 164 of the feed cables 150 and 160. The coupling between the conductive shieldings 154 and 164 of the feed cables 150 and 160 gets stronger when the operating frequency of the cellular antenna 120 increases because the capacitance provides lower reactance when the frequency increases. The coupling can occurs also over the gap between ground plane of GPS antenna 110 and conductive element sections 140 and 150. Accordingly, the ground plane of GPS antenna 110 can effectively operate as the counterpoise for the cellular antenna 110 when the cellular antenna 120 is operating at higher frequencies.

As seen in FIG. 2, the GPS antenna 110 is also mounted to the substrate 130. The feed cable 150 for the GPS antenna 110 exits the substrate 130 at a different angle than the feed cable 160 for the cellular antenna 120. The angle between the feed cable 150 and the feed cable 160 illustrated in FIG. 2 is about fifty degrees. This allows the feed cable 150 and the feed cable 160 to be isolated from each other while still exiting the substrate 130 in a manner that simplifies the installation of the antenna device 100. However, any angle greater than around fifty degrees could be used depending upon the desired isolation and size characteristics desired by the implementer of the antenna device 100.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An antenna device, comprising:

a first feed cable comprising a conductive core and a conductive shielding;

a substrate, wherein the substrate does not include a sufficient counterpoise for low cellular bands;

a monopole antenna mounted to the substrate, the monopole antenna galvanically coupled to the conductive core of the first feed cable, the monopole antenna configured to radiate within a first frequency band when fed a signal by the conductive core of the first feed cable, wherein the monopole antenna further comprises a conductive extension;

a tuning element galvanically coupled to the conductive shielding of the first feed cable, the tuning element arranged to capacitively couple with the conductive extension of the monopole antenna; and a conductive coupling element galvanically coupled to the conductive shielding of the first feed cable, the conductive coupling element comprising:

a first conductive element configured to radiate within a second frequency band when the monopole antenna is fed the signal by the conductive core of the first feed cable; and a second conductive element configured to radiate within a third frequency band when the monopole antenna is fed the signal by the conductive core of the first feed cable.

2. The antenna device of claim 1, further comprising:

a global positioning system antenna mounted to the substrate; and a second feed cable coupled to the global positioning system antenna.

3. The antenna device of claim 2, wherein the first feed cable and the second feed cable exit the substrate at different angles.

4. The antenna device of claim 2, wherein an angle between the first feed cable and the second feed cable is greater than fifty degrees.

5. The antenna device of claim 1, wherein the first conductive element further comprises:

at least one conductive linear segment galvanically coupled to the conductive shielding of the first feed cable; and a conductive tip galvanically coupled to the at least one conductive linear segment.

6. The antenna device of claim 5, wherein the second conductive element further comprises:

a conductive linear segment galvanically coupled to the conductive tip of the first conductive element; and a conductive end galvanically coupled to the conductive linear segment of the second conductive element.

7. The antenna device of claim 6, wherein the at least one conductive linear segment of the first conductive element and the conductive linear segment of the second conductive element are galvanically coupled to a first end of the conductive tip.

8. A location device, comprising:

a controller controlling a radio unit;

a first feed cable comprising a conductive core coupled to the radio unit controlled by the controller and a conductive shielding;

a second feed cable comprising a conductive core coupled to the radio unit controlled by the controller and a conductive shielding;

a substrate, wherein the substrate does not include a sufficient counterpoise for low cellular bands;

a global positioning system antenna mounted to the substrate, the global positioning system antenna galvanically connected to the second feed cable;

a monopole antenna mounted to the substrate, the monopole antenna galvanically coupled to the conductive core of the first feed cable, the monopole antenna configured to radiate within a first frequency band when fed a signal from the controller through the conductive core of the first feed cable; and a conductive coupling element galvanically coupled to the conductive shielding of the first feed cable, the conductive coupling element comprising:

a first conductive element configured to radiate within a second frequency band when the monopole antenna is fed the signal from the controller through the conductive core of the first feed cable; and a second conductive element configured to radiate within a third frequency band when the monopole antenna is fed the signal from the controller through the conductive core of the first feed cable.

9. The location device of claim 8, wherein the first feed cable and the second feed cable exit the substrate at different angles.

10. The location device of claim 8, wherein an angle between the first feed cable and the second feed cable is greater than fifty degrees.

11. The location device of claim 8, wherein the monopole antenna further comprises a conductive extension.

12. The location device of claim 11, further comprising a tuning element galvanically coupled to the conductive shielding of the first feed cable, the tuning element arranged to capacitively couple with the conductive extension of the monopole antenna.

13. The location device of claim 8, wherein the first conductive element further comprises:

at least one conductive linear segment galvanically coupled to the conductive shielding of the first feed cable; and a conductive tip galvanically coupled to the at least one conductive linear segment.

14. The location device of claim 13, wherein the second conductive element further comprises:

a conductive linear segment galvanically coupled to the conductive tip of the first conductive element; and a conductive end galvanically coupled to the conductive linear segment of the second conductive element.

15. The location device of claim 14, wherein the at least one conductive linear segment of the first conductive element and the conductive linear segment of the second conductive element are galvanically coupled to a first end of the conductive tip.

16. An antenna device, comprising:

a first feed cable comprising a conductive core and a conductive shielding;

a substrate, wherein the substrate does not include a sufficient counterpoise for low cellular bands;

a monopole antenna mounted to the substrate, the monopole antenna galvanically coupled to the conductive core of the first feed cable, the monopole antenna configured to radiate within a first frequency band when fed a signal from the conductive core of the first feed cable; and a conductive coupling element galvanically coupled to the conductive shielding of the first feed cable, the conductive coupling element comprising:

a first conductive element configured to radiate within a second frequency band when the monopole antenna is fed the signal from the conductive core of the first feed cable, the first conductive element comprising:

at least one conductive linear segment galvanically coupled to the conductive shielding of the first feed cable; and a conductive tip galvanically coupled to the at least one conductive linear segment; and a second conductive element configured to radiate within a third frequency band when the monopole antenna is fed the signal from the conductive core of the first feed cable, the second conductive element comprising:

a conductive linear segment galvanically coupled to the conductive tip of the first conductive element; and a conductive end galvanically coupled to the conductive linear segment of the second conductive element.

17. The antenna device of claim 16, further comprising:

a global positioning system antenna mounted to the substrate; and a second feed cable coupled to the global positioning system antenna, wherein the first feed cable and the second feed cable exit the substrate at different angles.

18. The antenna device of claim 17, wherein an angle between the first feed cable and the second feed cable is greater than fifty degrees.

* * * * *